US011384592B2

(12) United States Patent
Machado Rainha

(10) Patent No.: US 11,384,592 B2
(45) Date of Patent: Jul. 12, 2022

(54) FRAME FOR MANUFACTURING LARGE-SURFACE DOORS OR WINDOWS

(71) Applicant: BBG S.A., Esposende (PT)

(72) Inventor: Hugo Miguel Machado Rainha, Maia (PT)

(73) Assignee: BBG S.A., Esposende (PT)

( * ) Notice: Subject to any disclaimer, the term of this patent is extended or adjusted under 35 U.S.C. 154(b) by 145 days.

(21) Appl. No.: 16/300,572

(22) PCT Filed: Apr. 28, 2017

(86) PCT No.: PCT/IB2017/052488
§ 371 (c)(1),
(2) Date: Nov. 11, 2018

(87) PCT Pub. No.: WO2017/195064
PCT Pub. Date: Nov. 16, 2017

(65) Prior Publication Data

US 2019/0203522 A1 Jul. 4, 2019

(30) Foreign Application Priority Data

May 10, 2016 (PT) ..... 109377

(51) Int. Cl.

| | |
|---|---|
| ***E06B 3/46*** | (2006.01) |
| ***E06B 3/263*** | (2006.01) |
| ***E06B 3/663*** | (2006.01) |
| ***E05B 65/08*** | (2006.01) |

(Continued)

(52) U.S. Cl.
CPC ..... *E06B 3/4609* (2013.01); *E05B 65/08* (2013.01); *E06B 3/12* (2013.01); *E06B 3/26343* (2013.01); *E06B 3/26347* (2013.01); *E06B 3/46* (2013.01); *E06B 3/469* (2013.01); *E06B 3/66* (2013.01); *E06B 3/66352* (2013.01);

(Continued)

(58) Field of Classification Search
CPC ..... E06B 3/46; E06B 3/4609; E06B 3/469; E06B 3/66; E05B 65/08
See application file for complete search history.

(56) References Cited

U.S. PATENT DOCUMENTS 4,667,441 A * 5/1987 Goddens ..... E06B 3/4609 49/404
10,316,577 B2 * 6/2019 Fontijn ..... E06B 3/4681

(Continued)

FOREIGN PATENT DOCUMENTS

CH 708701 4/2015
EP 2 361 339 * 6/2013

(Continued)

*Primary Examiner* — Gregory J Strimbu
(74) *Attorney, Agent, or Firm* — Mark M. Friedman

(57) ABSTRACT

A frame system for a door or window is constituted by at least one fixed frame (1) and at least one movable sash (3) mounted in the fixed frame and having a central post (5) and a handle (4). The locking system (6) for the sash (3) is integrated in the aluminum profiles of the fixed frame (1). The sash (3) has no visible aluminum profiles next to the floor and next to the ceiling. The thickness of the visible aluminum of the post and of the handle ranges from 1 mm to 5 mm and the central post (5) and the handle (4) can be mounted to either side of the movable sash without modification.

12 Claims, 3 Drawing Sheets

(51) Int. Cl.
*E06B 3/12* (2006.01)
*E06B 3/66* (2006.01)

(52) U.S. Cl.
CPC ..... *E06B 3/66366* (2013.01); *E05Y 2900/132* (2013.01); *E05Y 2900/148* (2013.01)

(56) References Cited

U.S. PATENT DOCUMENTS

| | | | | |
|---|---|---|---|---|
| 2009/0229201 | A1* | 9/2009 | Hanssen | E06B 3/2605 52/202 |
| 2012/0005975 | A1* | 1/2012 | Kim | E06B 7/26 52/209 |
| 2015/0121764 | A1* | 5/2015 | Lee | E05D 15/0678 49/420 |
| 2015/0247358 | A1* | 9/2015 | Kim | E06B 7/28 49/406 |
| 2019/0383078 | A1* | 12/2019 | Tsimbikos | E05D 15/0665 |
| 2020/0056419 | A1* | 2/2020 | Lee | E06B 9/52 |

FOREIGN PATENT DOCUMENTS

| | | |
|---|---|---|
| EP | 2853674 | 4/2015 |
| WO | 2017195064 | 11/2017 |

* cited by examiner

FRAME FOR MANUFACTURING LARGE-SURFACE DOORS OR WINDOWS

CROSS-REFERENCE TO RELATED APPLICATIONS

N/A

STATEMENT REGARDING FEDERALLY SPONSORED RESEARCH OR DEVELOPMENT

N/A

THE NAMES OF THE PARTIES TO A JOINT RESEARCH AGREEMENT

N/A

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

N/A

STATEMENT REGARDING PRIOR DISCLOSURES BY THE INVENTOR OR A JOINT INVENTOR

N/A

FIELD OF THE INVENTION

The present invention relates to frames for manufacturing large area doors or windows, having no visible aluminum profiles near the floor and near the ceiling, which is within the field of mechanical engineering applied to civil engineering, more specifically regarding fixed construction elements. Additionally, the invention falls within the scope of the International Patent Classification E06B7/14; E06B03/46; E06B5/20 and E06B7/23.

BACKGROUND OF THE INVENTION

It must be mentioned that the closest document to the state-of-the art of the invention is the patent application EP2853674, which differs from the present invention in that the post and the handle are only 1 mm to 5 mm visible and in this way it is possible to hide the fixed frame (1) in the floor, in the ceiling and in the walls.

SUMMARY OF THE INVENTION

The present invention has the following advantages over the aforementioned prior art:

a) No visible aluminum profiles near the floor and near the ceiling;

b) At the heights near the posts (5) only 1 mm to 5 mm of aluminum is visible;

c) The profiles of the posts (5) have thermal break;

d) At the heights near the handles (4) only 1 mm to 5 mm of aluminum is visible;

e) The upper and lower profiles (2) of the sash (3) are not visible and they are a structural part of the sash, and low friction material bars are attached in the lower profile (2). These bars are in contact with the bearings thus allowing a smooth sliding of the sashes;

f) The thickness of the glass panes can vary from 34 mm to 60 mm, only by changing the peripheral profile (7) which is coupled to the sashes (3), and keeping unchanged the profiles of the fixed frame (1);

g) Possibility of movement of the sashes (3) in parallel or perpendicular planes;

h) Any type of fixation elements—such as screws, female fittings, rivets or other—are not visible;

i) Using the same profiles, it is possible in with this system to produce frames with positive or negative slope, attic ceiling frames, skylights, guillotines, and pivoting doors.

DESCRIPTION OF THE PREFERRED EMBODIMENTS

The present invention is an aluminum and glass frame system for doors or windows, which is applied in an opening of a building.

Figure 1:
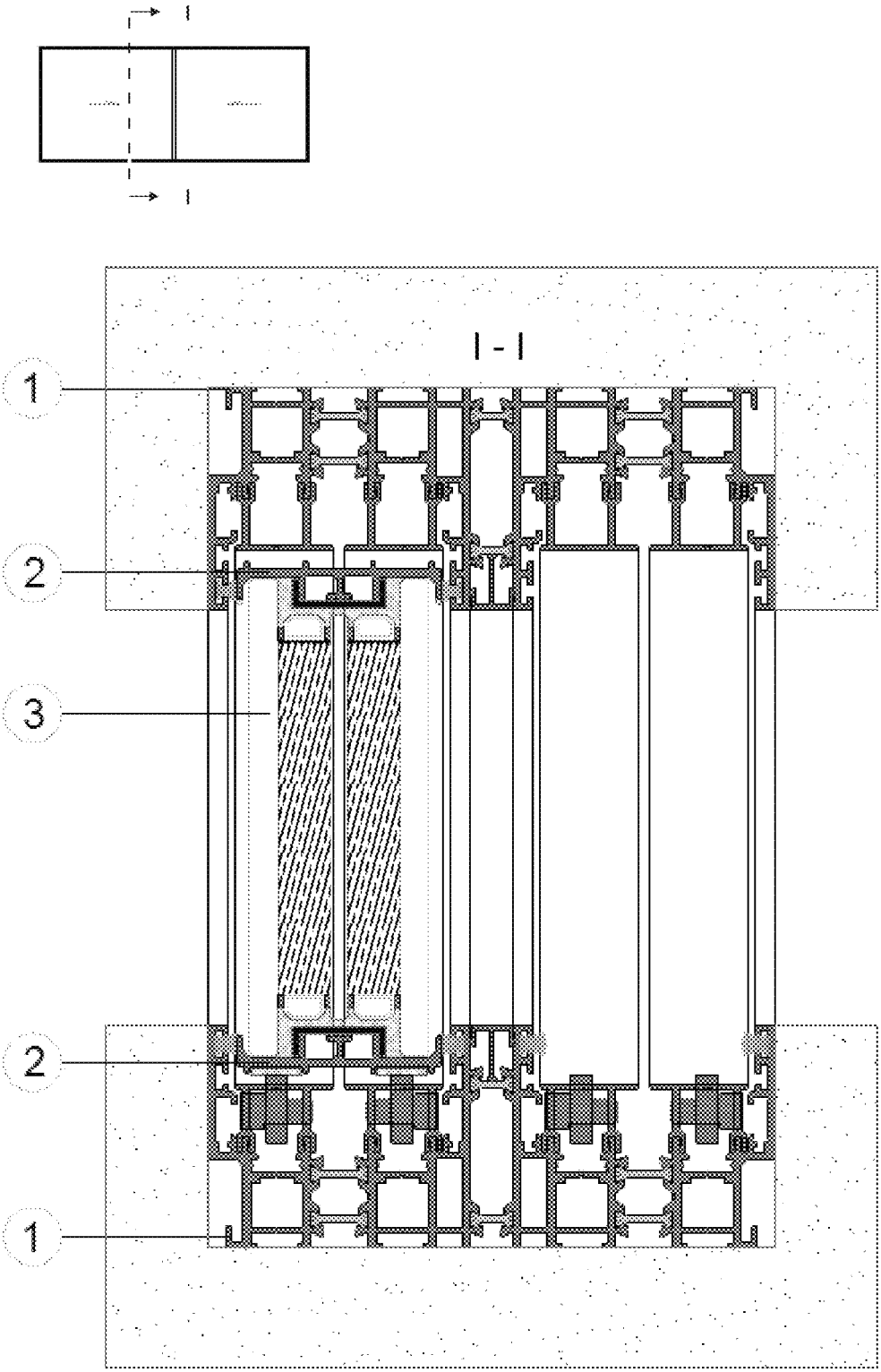
FIG. 1—Graphical representation of the frames-vertical section.
Figure 2:
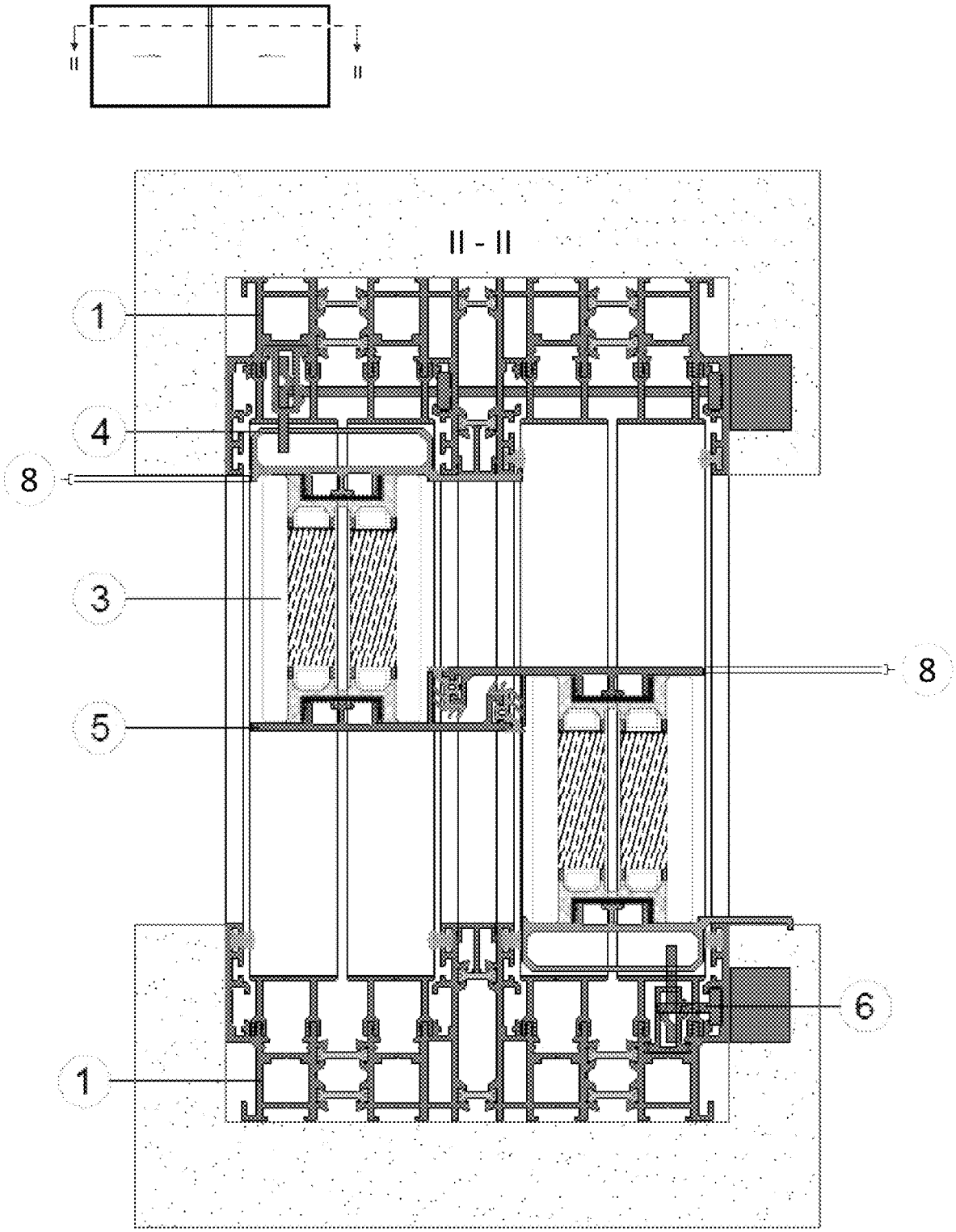
FIG. 2—Graphic representation of the frames horizontal section.
Figure 3:
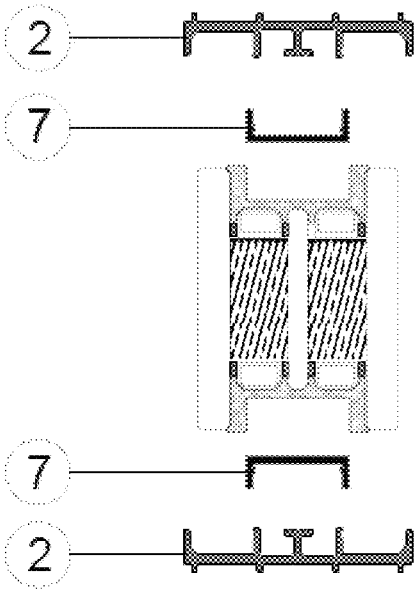
FIG. 3—Graphical representation of the sashes (3) that compose the vertical section system.
Figure 4:
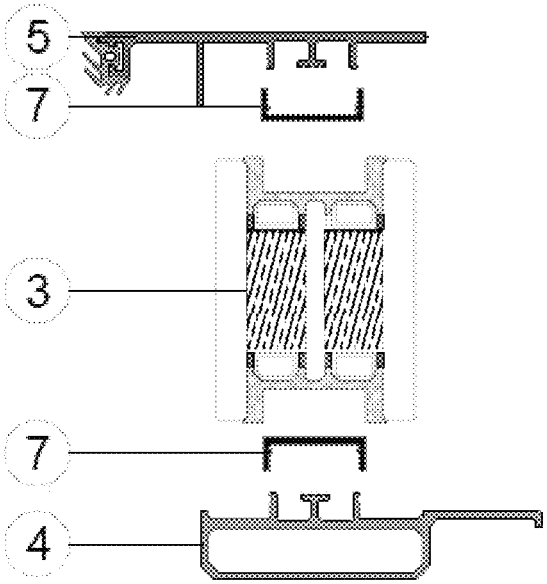
FIG. 4—Graphical representation of the sashes (3) that compose the horizontal section system.

The present invention is constituted by at least one fixed frame (1) and by just one or several fixed or movable sashes (3), which are inserted inside the fixed frame (1) and move laterally in parallel or perpendicular planes. The sashes (3) can be moved by hand or in a motorized way, and may consist of single, double, or triple panes of glass or other type of material. The sashes (3) have a central post (5), as shown in FIG. 2, with 1 mm to 5 mm of visible aluminum (8). At the other end it is possible they include an equally visible handle (4) with 1 mm to 5 mm of visible aluminum (8). In this way there are no visible aluminum profiles in the floor or in the ceiling.

The fixed frame (1) is peripheral and consists of a rigid aluminum frame, preferably rectangular or square. All sides of the fixed frame (1) are formed by the same profile, and are joined together by any means known in the art.

In any of these cases it is always used the same fixed frame profile (1).

The sash (3) has a peripheral profile (7) which is attached to glass by a gluing process or any other known in the art, in which this profile has a structural function and allows interchangeable fitting the profiles of the handle (4) and of the post (5) by means of a friction fit or by gluing. This profile can be made of aluminum or polyamide.

The sash (3) can have glass thicknesses ranging from 34 mm to 60 mm, for which it is only necessary to replace the peripheral profile (7) with an equivalent one that spans a majority of the thickness of the glass.

The sashes (3) can be operated by hand or automatically. The profiles forming the fixed frame (1) have been developed in order to allow the automation of the sashes (3) movement without needing to add more profiles to the system.

The locking system (6) of the movable sashes is integrated in the aluminum profiles of the fixed frame (1) and allows adjusting the number of locking points to the size of the movable sashes. The locking system (6) is multipoint, the number of locking points being adjusted according to the height and weight of the sashes (3).

LIST OF REFERENCE NUMBERS fixed frame (1);
lower/upper profile (2);
movable/fixed sashes (3);
handle (4);
central post (5);
locking system (6) of the movable sashes;
peripheral profile (7);
1 mm 5 mm visible aluminum (8).

The invention claimed is:

1. A frame system for doors or windows comprising:

a) a peripheral fixed aluminum frame (1) having a single cross-sectional profile;

b) at least one movable sash (3) inserted inside said fixed frame (1), said at least one movable sash moves laterally in a plane of movement parallel to a plane of said fixed frame;

c) a locking system (6) for the at least one movable sash (3) integrated into said fixed frame (1), said locking system (6) being multipoint;

wherein the at least one movable sash (3) comprises:

(i) at least one pane of glass, (ii) a post (5) and a first peripheral profile both disposed at a first end the at least one moveable sash, (iii) an upper profile (2) and a lower profile (2), (iv) a handle (4) and a second peripheral profile both disposed at a second end of the at least one movable sash opposite said first end, (v) an adhesive layer disposed between the first peripheral profile and the at least one pane of glass and an adhesive layer disposed between the second peripheral profile and the at least one pane of glass, and (vi) the first and second peripheral profiles each have a thickness that spans a majority of a thickness of said at least one pane of glass;

wherein for said at least one movable sash, when viewed from an angle perpendicular to said plane of movement, said post (5) and said handle (4) each have a visible width of at least 1 mm and at most 5 mm at least when said at least one movable sash is in a closed position, wherein said lower and upper profiles are disposed in a floor and a ceiling respectively; and wherein said handle (4) has a first coupling mechanism and said post has a second coupling mechanism, wherein said first and second coupling mechanisms are the same so that either of the post and the handle can be mounted on either of said first and second peripheral profile without modification of said peripheral profiles and without modification of said coupling mechanisms, wherein each of said coupling mechanisms comprises two side protrusions and a T-shaped central post disposed between said two side protrusions, wherein for each of said coupling mechanisms, said two said protrusions engage within a respective one of said peripheral profiles with a friction fit while said T-shaped central post is disposed within and engages said respective one of said peripheral profiles.

2. The frame system according to claim 1, wherein said at least one pane of glass consists of two or three panes of glass.

3. The frame system according to claim 2, wherein said at least one pane of glass has a thickness of between 34 mm and 60 mm.

4. The frame system according to claim 3, wherein the peripheral profiles (7) are made of aluminum or polyamide.

5. The frame system according to claim 2, wherein the peripheral profiles (7) are made of aluminum or polyamide.

6. The frame system according to claim 1, wherein said at least one pane of glass has a thickness of between 34 mm and 60 mm.

7. The frame system according to claim 6, wherein the peripheral profiles (7) are made of aluminum or polyamide.

8. The frame system according to claim 1, wherein the peripheral profiles (7) are made of aluminum or polyamide.

9. The frame system according to claim 1, further comprising at least one fixed sash inserted inside said fixed frame.

10. The frame system according to claim 9, wherein said at least one fixed sash has one, two or three panes of glass.

11. The frame system according to claim 10, wherein said one, two or three panes of glass of the at least one fixed sash have an overall thickness of between 34 mm and 60 mm.

12. The frame system according to claim 11, wherein the peripheral profiles (7) are made of aluminum or polyamide.

* * * * *